United States Patent [19]

Stifano, Jr.

[11] 4,291,568

[45] Sep. 29, 1981

[54] METHOD OF FORMING SOCKET WRENCHES

[75] Inventor: Vincent A. Stifano, Jr., Wethersfield, Conn.

[73] Assignee: Veeder Industries Inc., Hartford, Conn.

[21] Appl. No.: 70,060

[22] Filed: Aug. 27, 1979

[51] Int. Cl.[3] ..... B21D 22/00

[52] U.S. Cl. ..... 72/356; 72/358; 72/377; 76/114

[58] Field of Search ..... 72/354, 356, 377, 352, 72/378; 76/114

[56] References Cited

U.S. PATENT DOCUMENTS

| | | | |
|---|---|---|---|
| 2,368,069 | 1/1945 | Poole et al. | 72/356 |
| 2,586,336 | 2/1952 | Hoch | 72/354 X |
| 3,124,876 | 3/1964 | Pulette | 72/354 X |
| 3,962,899 | 6/1976 | Hubbell | 72/354 |
| 4,061,013 | 12/1977 | Kuc | 72/354 |
| 4,078,415 | 3/1978 | Koch | 72/354 |

*Primary Examiner*—Leon Gilden
*Attorney, Agent, or Firm*—Hayes & Reinsmith

[57] ABSTRACT

The disclosed method features an automatic high production cold working process of forming socket wrenches from coiled alloy steel wire stock. The wire is cut to length, its ends are squared to form a workpiece blank which is then located in a die station and a recess of circular cross-section is cold formed at one end of the workpiece by impacting a round punch into the workpiece which thereafter is transferred to and inserted into a downstream die in a longitudinally reversed orientation whereupon a second punch forms a square socket on an end of the workpiece opposite the end wherein the circular recess is formed. Additional steps of the process include extruding an end of the workpiece surrounding the circular recess to reduce its outside diameter, broaching a hex socket into the necked-down end of the workpiece and piercing an axial through-hole between sockets at opposite ends of the workpiece.

13 Claims, 24 Drawing Figures

10
12
14
16

18

20
22
24
26
30
18a 28
18a
36

32
38
36
34
40
42
18b 28
18b
42

54
44
42
52
48
50
46
46a
18c 42
56
18c
58
52

60
42a
78
62
66
64
18d 42a
56
18d
78
58
52

68
76
74
72
42a
18e
80
70

42a
56
74
18e
58
80
52

10
12
14
16

18

20
22
24
26
30
18a 28
18a 32
38
36
34
40
42
18b 28
18b
42

144
42
148
190
118c
192

42
118c
152

160
194
198
196
200
176
156
180
42
118d
202

42
156
174
118d
180
152

168
204
162
166
42a
174
118e 156
42a
118e
174
152

METHOD OF FORMING SOCKET WRENCHES

FIELD OF THE INVENTION

This invention generally relates to cold work forming processes and particularly concerns an improved method of forming socket wrenches in a cold working process.

BACKGROUND OF THE INVENTION

Various processes have been used in the past in forming socket wrenches. The socket wrench itself is a standard device, well known in the art, having conventional square drive socket at one end, releasably attachable to a drive tang of a handle unit, and a fastener socket coaxially formed at an opposite end of the wrench which fastener socket is normally of hexagonal cross-section. A through-hole extends between the coaxially aligned sockets and serves to provide clearance, e.g., for a shank of a bolt on which a nut received within the hex fastener socket is being tightened by the wrench. Standard screw machines have been utilized in the manufacture of such wrenches wherein a plurality of different machining operations are effected in a multiplicity of different manufacturing steps. In addition, both hot and cold forged processes have been utilized. The resulting products of these processes have been found to be relatively expensive to produce.

OBJECTS OF THE INVENTION

A primary object of this invention is to provide a new and improved cold forming method of forming socket wrenches utilizing multiple die stations through which a single workpiece is sequentially fed to provide a continuous, automatic high-production process to cold form a high quality, low cost socket wrench.

Another object of this invention is to provide such a cold forming process of making socket wrenches wherein the machining operations customarily encountered in the prior art are essentially eliminated.

A further object of this invention is to provide a method of the type described particularly suited to provide repetitive uniform quality of the finished product over extended periods of machine operation under demanding conditions utilizing alloy steel material which is not easily cold worked for the production of socket wrenches in a variety of sizes.

Other objects will be in part obvious and in part pointed out in more detail hereinafter.

A better understanding of the objects, advantages, features, properties and relations of the invention will be obtained from the following detailed description and accompanying drawings which set forth illustrative embodiments and are indicative of the various ways in which the principles of the invention are employed.

SUMMARY OF THE INVENTION

The method of this invention includes a series of steps wherein a workpiece is transferred progressively through die stations wherein the workpiece is initially squared up on its ends and one end is then formed with a recess under the driving force of a moving punch. The workpiece is subsequently reversed end to end in its orientation upon introduction to a downstream die station wherein the opposite end of the workpiece is exposed to be formed with a second recess under the driving force of a moving punch. Additional cold forming operations include extruding one end of the workpiece about its recess to provide a necked-down or reduced outside diameter end and piercing a through-hole to connect the recesses at opposite ends of the workpiece.

Figures 1, 1A, 2, 2A, 3, 3A, 4, 4A, 5, 5A, 6, 6A:
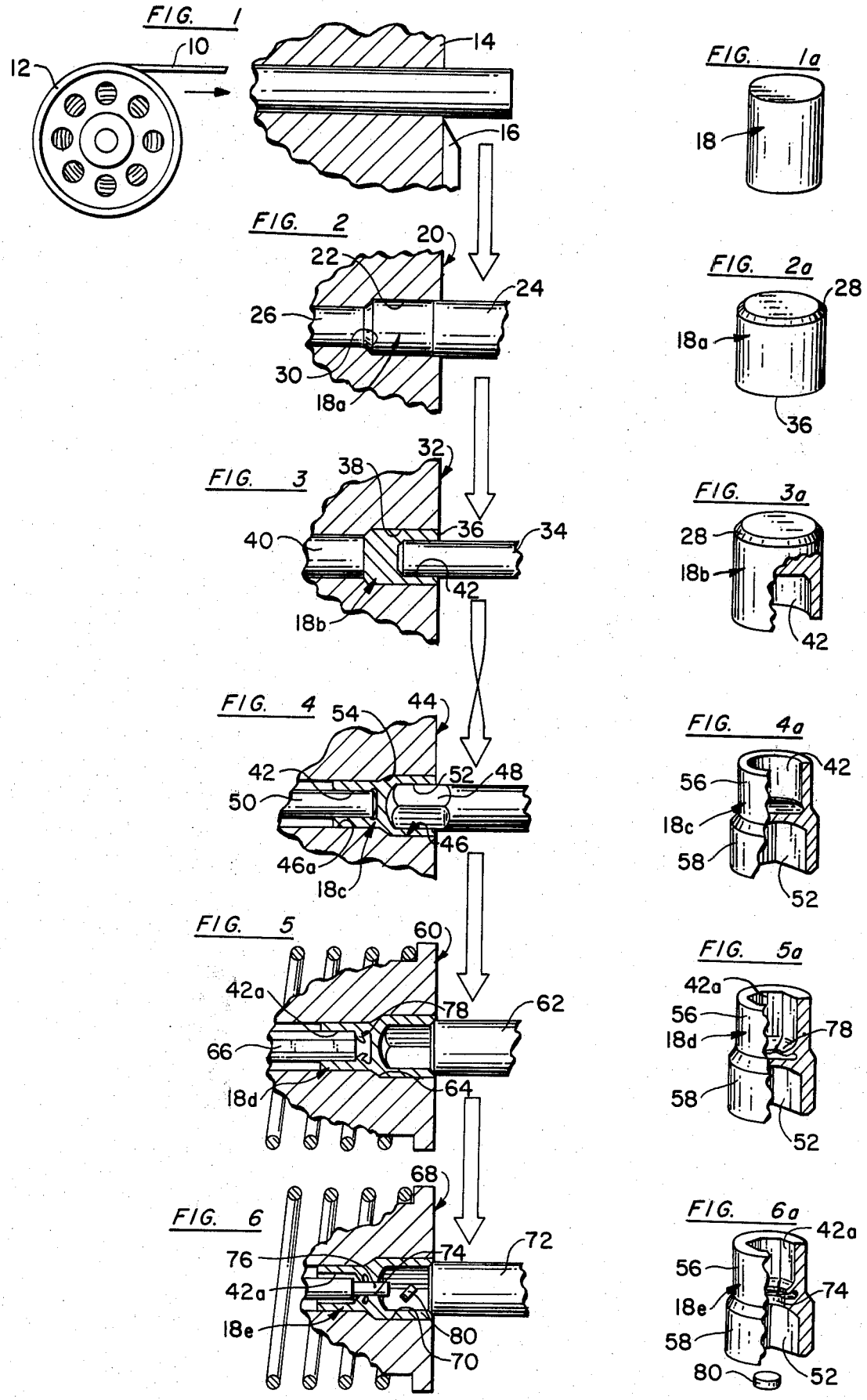
FIGS. 1–6 are schematic representations showing one embodiment of a method of this invention.

FIGS. **1*a*–6*a* are isometric views of the workpiece corresponding to the steps illustrated in FIGS. 1–6**, respectively;

FIGS. 7–12 are schematic representations of certain steps of a second embodiment of the method of this invention; and FIGS. **7*a*–12*a* are isometric views of the workpiece as it is sequentially formed respectively by the steps illustrated in FIGS. 7–12**.

DESCRIPTION OF THE PREFERRED EMBODIMENTS

Referring in detail to the embodiment of the method steps shown in FIGS. 1–6 and the corresponding FIGS. **1*a*–6*a* showing a workpiece at each respective step of the disclosed method, metal wire stock 10 is illustrated as being supplied on a reel 12 to be paid off upon demand. To provide a finished quality product having a desired hardness, the established composition of the metal wire stock 10 is such that it is not easily or readily cold formed. However, in accordance with the disclosed method of this invention, it has been found that even wire of alloy steel such as AISI 4037 between B65 and B90 Rockwell, which includes a manganese content between 0.70% and 0.90% by weight, is capable of being cold formed to provide quality socket wrenches. The wire 10 accordingly is supplied in coiled form and is preferably a spherorized heading grade alloy wire suitably coated, e.g., with a phosphate coating. The wire 10 is initially paid off reel 12 and fed into straightening rolls, not shown, of conventional structure, and the straightened wire 10 is fed into a cut-off die 14 until a predetermined length of wire protrudes through the die 14. A shear 16 then moves across the face of cut-off die 14 and severs the protruding wire length into a generally cylindrical workpiece 18 which is then transferred by suitable transfer fingers, not shown, in a well-known manner to carry the metal workpiece 18 into longitudinally aligned position with a first die station 20 which has a die cavity 22 of a volume substantially equal to that of the workpiece 18. A ram, not shown, moves a driving punch 24 to force the workpiece 18 into the cavity 22 to an extent limited by a knock-out stop pin 26 whereby the ends of the workpiece 18 are squared in parallel planes normal to its longitudinal axis. The leading end of the workpiece 18 is preferably chamfered at 28 by a correspondingly tapered wall surface 30 of the die cavity 22. Upon retraction of the ram and its punch 24, the knock-out pin 26 moves to eject the squared workpiece 18*a* from the die 20, and workpiece 18*a* is moved by transfer fingers, not shown, into axial alignment with a second die station 32**.

In accordance with one aspect of this invention, excellent quality has been found to be achieved in the product of the disclosed process by forming recesses in opposite ends of the workpiece **18*a* in separate manufacturing steps. At the second die station 32, a ram operated, round punch 34 (of a predetermined reduced diameter relative to the workpiece end 36) is axially aligned with the longitudinal axis of the workpiece 18***a* and die cavity 38. Punch 34 serves to drive the workpiece 18*a* into the cavity 38 against stop pin 40 to form a longitudinally directed, axially aligned socket 42 of circular cross-section within the trailing exposed end 36 of the workpiece upon continued travel of the round punch 34 into the workpiece a predetermined distance which is preferably slightly less than half its length. As the punch 34 recedes, the stop pin 40 moves to eject the workpiece 18*b* from the die 32.

To optimize the manufacturing process and to impact the workpiece 18*b* with the full thrust of the moving ram, not shown, and its associated punches in accordance with this invention, the workpiece 18*b* is then longitudinally reversed end for end by a suitable transfer device, not shown, and moved into aligned registration with a third die station 44, which in the illustrated embodiment of FIGS. 1–6, is a compound extruding and socket forming die station. At this die station 44, the previously formed recess 42 of workpiece 18*b* is initially inserted into cavity 46 of the die 44 under the driving force of ram operated, square punch 48 which seats workpiece 18*b* against punch 50 and forms a square socket 52 in the workpiece by exerting sufficient pressure on it to cause cold forming flow of metal between an interior necked-down cavity portion 46*a* of the die 44 below its reduced diameter neck 54 and the external surface of round punch 50 which is illustrated as being centrally located within the necked-down cavity portion 46*a* of die 44. Accordingly, the outside diameter of the workpiece end 56 which surrounds recess 42 is reduced or necked-down, without any need for a machining operation, in an economical manner which is readily repeated to provide consistently uniform part dimensions and is suited for an automatic manufacturing operation.

Upon retraction of the square punch 48, the round punch 50 is driven to eject the workpiece 18*c* (FIG. 4*a*). Workpiece 18*c* now is provided with a necked-down end 56 having a recess 42 of circular cross-section and an opposite end having a socket 52 with a square cross-section and circular outside wall 58 of enlarged diameter relative to the necked-down end 56 of the workpiece 18*c*.

By virtue of the above-described steps in the method disclosed, coaxially aligned recesses 42 and 52 at opposite ends of the workpiece are precision formed in separate steps in the manufacture of the socket wrench under precisely controlled conditions utilizing the full force and effect of the moving ram and its associated punches.

Thereafter, the workpiece 18*c* is moved from die station 44 into longitudinal alignment with a broaching die station 60 wherein a ram operated punch 62 drives the workpiece into tapered die cavity 64 to engage a broaching punch 66 of hexagonal cross-section having a minimum cross-sectional dimension slightly greater than the diameter of recess 42 in workpiece 18*c*. Die 60 is preferably a spring-loaded movable die, and punch 66 is centrally located (in fixed relation to the movable punch 62) within the interior end of the die cavity 64 for accurately broaching the recess 42 within the necked-down end 56 of the workpiece by pushing and shearing the metal ahead of the hexagonal punch 66 within the recess 42. Accordingly, a hex socket 42*a* is formed along a predetermined length of the workpiece wall. The hex socket length is shown in FIGS. 5 and 5*a* as being slightly greater than half the length of recess 42. Once the movable punch 62 is retracted, the workpiece 18*d* is driven from the die cavity 64 to be transferred to the next die at a piercing die station 68. The workpiece 18*d* is driven into tapered die cavity 70 in alignment therewith by a suitable punch 72 and a through-hole 74 interconnecting the sockets 42*a* and 52 of the workpiece 18*e* is formed by a piercing punch 76 suitably mounted (in fixed relation to moving punch 72) in the spring-loaded movable die 68. Punch 76 is of reduced diameter to pierce any broaching chip such as at 78 (FIG. 5*a*) and to knock out a thin wafer-like slug 80 between the sockets 42*a*, 52. Both the slug 80 and the workpiece 18*e* are thereafter knocked out of the die 68 in any suitable manner upon retraction of the punch 72 whereupon the process is completed upon discharge of the workpiece 18*e* from the machine.

The product of the described process is a high quality, precisely cold formed socket wrench having a square drive socket at one end which is of enlarged cross-section relative to the fastener driving hex socket at the opposite necked-down end of the body with a clearance through-hole therein. Thereafter, the opposite ends of the socket wrench may be trimmed, if desired, to specific dimensions for chamfers, lengths, etc. in a secondary metal removing operation and suitably heat treated to achieve a desired Rockwell hardness.

Turning now to the second embodiment of this invention illustrated in FIGS. 7–12 and FIGS. 7*a*–12*a*, it is to be understood that the above described method steps of FIGS. 1–3 are identical to initial steps 7–9 in the second embodiment of this invention. With the recess 42 of circular cross-section formed in the workpiece 18*b* (FIG. 9*a*) as described above in connection with FIG. 3, the workpiece 18*b* is then turned end for end and transferred into aligned registration with die 144 having a round stop pin 190 of reduced diameter relative to the recess 42 of the workpiece 18*c*. The workpiece is then compressively driven into the cavity 192 of the die 144, to an extent limited by the round stop pin 190, under the driving force of the movable square punch 148 which causes cold forming flow of metal about the exterior wall of the square punch 148 and between punch 148 and the internal wall of cavity 192 to form a square socket 152. Upon retraction of the square punch 148, the round stop pin 190 moves the workpiece 118*c* out of the die 144 whereupon the workpiece 118*c* may be transferred directly into alignment with the next downstream die 160 shown having an internal tapered wall surface 194 between an outer circular wall 196 and a coaxially aligned interior circular wall 198 of relatively reduced diameter.

Figures 7, 7A, 8, 8A, 9, 9A, 10, 10A, 11, 11A, 12, 12A:
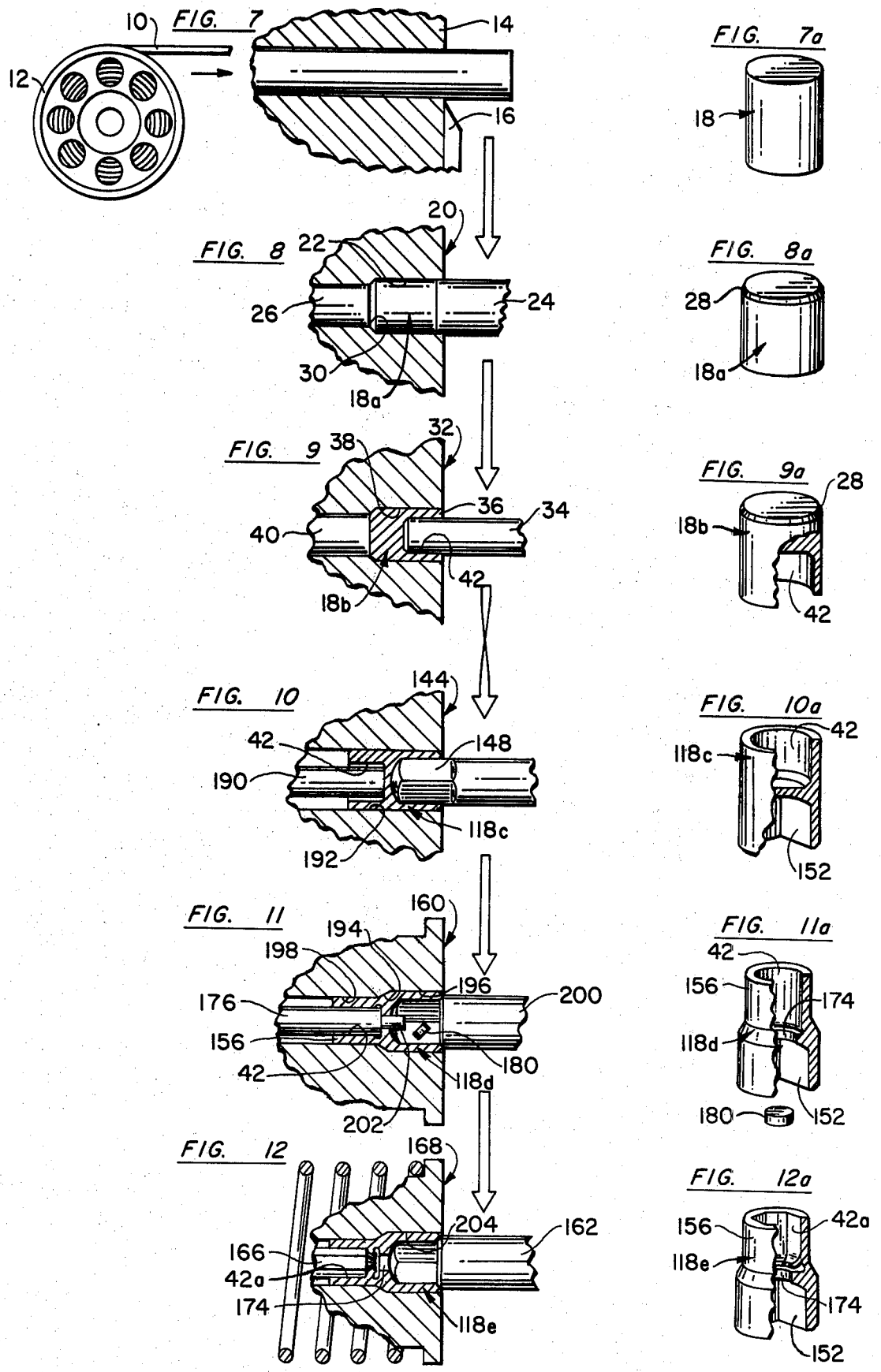

To reduce the outside diameter of the workpiece end 156 about the circular recess 42, a round driving punch 200 forces the workpiece 118*c* into the cavity of die 160 and extrudes the metal of the workpiece surrounding the previously formed circular recess 42 about a fixed round punch 176, which is centrally received within the cavity of die 160, and between punch 176 and the surrounding internal surface of the reduced die cavity wall 198. The round punch 176 within die 160 is shown having a reduced leading end 202 which pierces a hole 174 between the opposite end recesses of the workpiece 118*d*. Upon retraction of the driving punch 200, the workpiece 118*d* is driven from the cavity of die 160 together with the pierced slug 180 whereupon the workpiece is transferred straight across into registration with die cavity 204 in the next die station 168. In this final die station, a broaching punch 166 is shown having a hexagonal cross-section of a minimum cross-sectional dimension slightly larger than the diameter of recess 42. Punch 166 is in relatively fixed relation to movable punch 162 and is coaxially oriented relative to the surrounding walls of the die 168 which is preferably a spring loaded movable unit. Upon workpiece 118*d* being forced into the die cavity 204 by the driving punch 162, a shearing action occurs as the broaching punch 166 shears the interior recess walls a predetermined distance along the length of the recess 42 at the reduced end 156 of the workpiece 118*e* to form an accurately sized socket 42*a* of hexagonal cross-section. Thereupon, the socket wrench as shown in FIG. 12*a* is knocked out of the die cavity 204, by suitable means after the punch 162 has been retracted, and is discharged from the machine.

It will be seen that high quality products may be precisely made in accordance with the disclosed method in a high production, low cost operation particularly suited for reliable production. As will be apparent to persons skilled in the art, various modifications, adaptations and variations of the foregoing specific disclosure can be made without departing from the teachings of the present invention.

I claim:

1. A method of cold forming socket wrenches comprising the steps of providing a generally cylindrical solid metal workpiece, aligning the workpiece with an internal cavity of a die, driving the workpiece into the die cavity with a power operated punch and simultaneously forming a first recess in one end of the workpiece in aligned relation with its longitudinal axis by cold flowing its metal material between the punch and die, transferring the workpiece from the first die and longitudinally reversing the workpiece end to end into alignment with an internal cavity of a second die, driving the workpiece into the cavity of the second die with a second power operated punch and simultaneously forming a second recess in the opposite end of the workpiece in coaxial alignment with its first recess by cold flow of the workpiece metal material about the second punch and the second die, and reducing the outside diameter of one end of the workpiece by driving it into a tapered die cavity and extruding the metal material of the workpiece between a third punch, received within the recess in said one end of the workpiece, and internal walls of the tapered die which are located in spaced surrounding relation to the third punch received within the recess in said one end of the workpiece.

2. The method of claim 1 including the step of broaching the recess in said one reduced end of the workpiece after the reducing step to form a fastener drive socket of non-circular cross-section.

3. The method of claim 2 wherein the broaching step is effected by providing a fourth punch of non-circular cross-section within a second tapered die cavity in coaxially spaced relation thereto wherein the fourth punch has a minimum cross-sectional dimension greater than the diameter of the recess in said one reduced end of the workpiece, and driving said one reduced end of the workpiece into the second tapered die cavity to simultaneously shear the metal from the internal wall of the recess in said one reduced end of the workpiece to form said fastener drive socket of non-circular cross-section.

4. The method of claim 1 wherein the first driving step is effected with the first punch being of circular cross-section to form said first recess of circular cross-section, wherein the second driving step is effected with the second punch being of square cross-section to form said second recess as a socket of square cross-section, and wherein the step of longitudinally reversing the workpiece end to end between the first and second driving steps causes opposite ends of the workpiece in the first and second dies to be impacted by the power operated first and second punches in separate cold forming steps.

5. The method of claim 4 wherein the second driving step and the reducing step are effected simultaneously, and including further steps of transferring the workpiece from the first tapered die and inserting said one reduced end of the workpiece into a cavity of a second tapered die having a non-circular broaching punch coaxially located therein, and driving the workpiece into engagement with the broaching punch for shearing the internal walls of the recess in said one reduced end of the workpiece to form a fastener socket of non-circular cross-section.

6. The method of claim 5 including the further step of transferring the workpiece from the second tapered die and inserting it into a third tapered die having a piercing punch coaxially located therein, and driving the workpiece into engagement with the piercing punch for removing any broaching chip and forming a clearance hole between the coaxially aligned sockets at opposite ends of the workpiece.

7. The method of claim 4 including the further step of transferring the workpiece from the second die to a third die having said tapered die cavity for effecting the reducing step.

8. The method of claim 7 including the further step of forming a clearance hole between the coaxially aligned sockets at opposite ends of the workpiece simultaneously with the reducing step by driving the workpiece into engagement with a piercing punch coaxially located within said tapered die cavity of the third die.

9. The method of claim 8 including the further step of transferring the workpiece from the third die and inserting said one reduced end of the workpiece into a tapered die cavity of a fourth die having a non-circular broaching punch coaxially located therein, and driving the workpiece into engagement with the broaching punch for shearing the internal walls of the recess in said one reduced end of the workpiece to form a fastener socket of non-circular cross-section.

10. The method of claim 1 including the step of squaring the ends of the metal workpiece in a punch and die operation prior to the first driving step to initially form the ends of the workpiece in parallel planes perpendicular to its longitudinal axis.

11. A method of cold forming socket wrenches comprising the steps of providing a generally cylindrical solid metal workpiece, aligning the workpiece with an internal cavity of a die, driving the workpiece into the die cavity with a power operated punch and simultaneously forming a first recess in one end of the workpiece in aligned relation with its longitudinal axis, transferring the workpiece from the die and aligning the workpiece with a tapered internal cavity of a subsequent die, driving the workpiece into the cavity of the subsequent die and simultaneously forming a second recess in the opposite end of the workpiece in coaxial alignment with its first recess, and reducing both the inside and outside diameters of said one end of the workpiece simultaneously with the second driving step.

12. The method of claim 11 further including the step of transferring the workpiece from said subsequent die to a further die and driving the workpiece into said further die for broaching the internal walls of said one reduced end of the workpiece.

13. The method of claim 11 including the further step of longitudinally reversing the workpiece end to end between the first and second driving steps.

* * * * *